United States Patent [19]

Baladi et al.

[11] 4,070,216

[45] Jan. 24, 1978

[54] METHOD OF PRODUCING A BAS-RELIEF WITH A MOTIF WHICH VARIES WITH LIGHT AND THE BAS-RELIEF THUS OBTAINED

[76] Inventors: André Baladi, 7, Eugene Pittard, Geneva, Switzerland; Roland Albert Baladi, 6bis, rue Bachaumont, Paris, France

[21] Appl. No.: 659,450

[22] Filed: Feb. 19, 1976

[30] Foreign Application Priority Data

Feb. 24, 1975 France ..... 75 05705

[51] Int. Cl.[2] ..... B66C 1/00

[52] U.S. Cl. ..... 156/63; 156/64; 356/72; 356/203; 428/156; D25/97

[58] Field of Search ..... D25/97; 96/35, 38.2, 96/38.1; 156/63, 64; 428/156; 350/320; 356/72, 203

[56] References Cited

U.S. PATENT DOCUMENTS

| | | | |
|---|---|---|---|
| 2,047,124 | 7/1936 | Cutts et al. | 96/35 |
| 3,087,404 | 4/1963 | Hase et al. | 96/35 |

*Primary Examiner*—Edward G. Whitby

*Attorney, Agent, or Firm*—Seidel, Gonda & Goldhammer

[57] ABSTRACT

A method of producing a bas-relief with a motif which varies with the light, characterized in that the original motif to be reproduced is divided into a grid. The intensity of the grey in each of the divisions of the grid is measured. A numerical value is assigned to each division. The numerical value represents an intensity of grey and corresponds to an element of the bas-relief. The elements of the bas-relief, in accordance with the way in which the grid is divided, are placed side by side in a manner such that the light rays simultaneously make surface shadow spots appear on each element of the bas-relief in accordance with the intensity of the grey of the original motif. The composition of the spots is seen by viewing the bas-relief from a distance and reproduces the original motif.

10 Claims, 5 Drawing Figures

Figure 2:
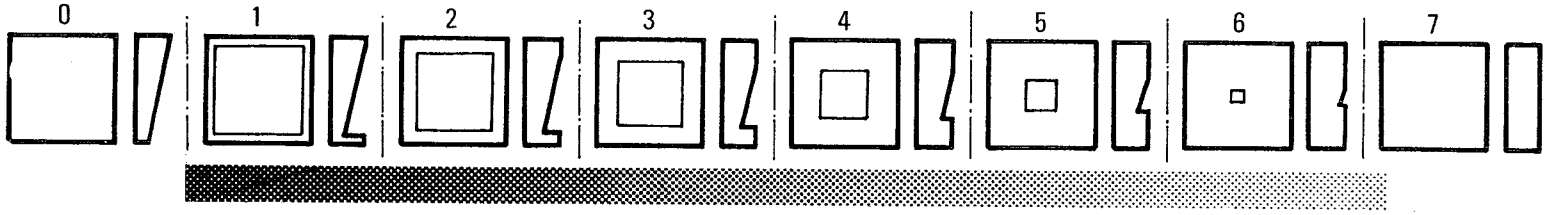

METHOD OF PRODUCING A BAS-RELIEF WITH A MOTIF WHICH VARIES WITH LIGHT AND THE BAS-RELIEF THUS OBTAINED

The present invention relates to a method of producing a bas-relief with a motif which varies with the light and the bas-relief thus obtained.

More particularly, this bas-relief is produced from elements consisting of solids with a plane front face comrising a cavity in the form of a notch; its illumination by incident light enables illuminated areas and shadow areas to be revealed which, suitably delimited, reproduce a motif or a defined image.

Means of producing an image by means of dark spots of variable density on a surface area already known: to achieve this; the picture to be reproduced is divided into a grid; the intensity of the grey in each division is measured and a black spot is made to correspond to this intensity, the area of which black spot is proportional to the value measured. These black spots of different areas are then arranged on the grid of the reproduction, and the basic picture then is found to have been reconstituted when it is viewed from a distance.

The present invention is intended to provide spots by means of the shadow produced on an object and to make a motif appear on the bas-relief, in particular by means of solar rays, either when the sun is in a defined position on its ecliptic or when the ecliptic occupies a defined position. It is moreover possible, with the aid of solar light, to make several images appear successively with time either on the same day, or on different days, on the same bas-relief.

To this end the invention relates to a method of producing a bas-relief with a motif which varies with light, characterized in that the original motif to be reproduced is divided into a grid, the intensity of the grey in each of the divisions of the grid is measured, a coefficient is applied to it corresponding to an element of the bas-relief, the elements of the bas-relief, in accordance with the way in which the grid is divided, are placed side by side in a manner such that the light rays simultaneously make surface shadow spots appear on each element of the bas-relief in accordance with the intensity of the grey of the original motif, the composition of which spots, seen by viewing the bas-relief from a distance, reproduces the original picture.

Thus, in the case of illumination by the sun, the shadow spots of unequal area, but related to the intensity of the desired degree of grey, make the image which it is desired to reproduce by viewing the whole from a distance, in accordance with the position of the sun on its ecliptic, or the position of the ecliptic.

According to another characteristic, the bas-relief element for applying this method, consists of a solid with a plane forward face comprising at least one cavity. According to another characteristic, this cavity is in the form of a notch and its plane base describes a defined angle with the plane forward face of the solid.

According to another characteristic, the area of the notch, with respect to the total plane area of the forward face of the solid, is variable and a function of the intensity of the desired degree of grey.

Thus, the area of the shadow is adjusted in accordance with the intensity of the desired degree of grey and by varying the areas, enables areas of a lesser or greater darkness to be obtained. In addition the angle between the base of a notch and the forward face enables, in the case of solar illumination, to delimit the duration of the appearance of the motif.

According to another characteristic, the bas-relief consists of an assembly of side-by-side bas-relief elements, the plane forward faces of the different solids being parallel to the same plane, the inclined faces of the notches forming a constant angle with this plane, the surface of each of the notches being in direct relation with the intensity measured on the motif to be reproduced.

Thus, it is possible to make a defined motif appear, by means of the shadow produced on the different notches: the instant of appearance depends of course, in the case of solar illumination, on the position of the bas-relief with respect to the plane of the ecliptic or with respect to the position of the sun on the ecliptic.

Figure 3:
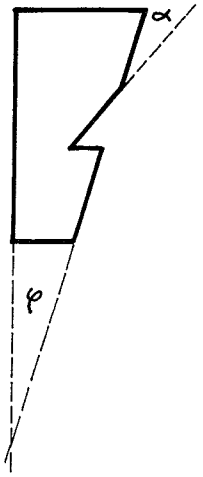
Figure 1:
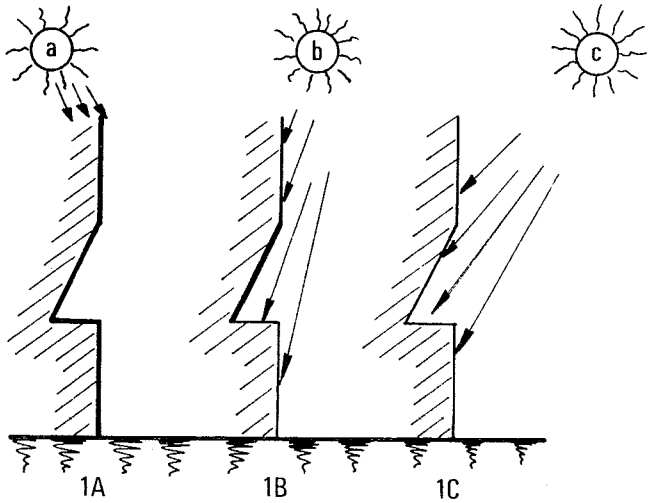
Figure 4:
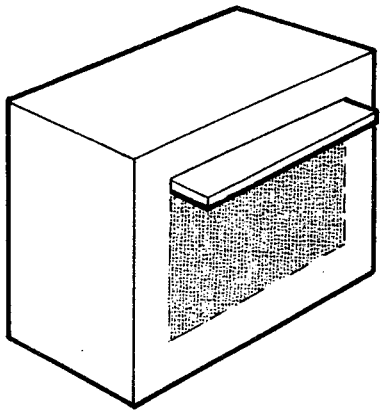
Figure 5:
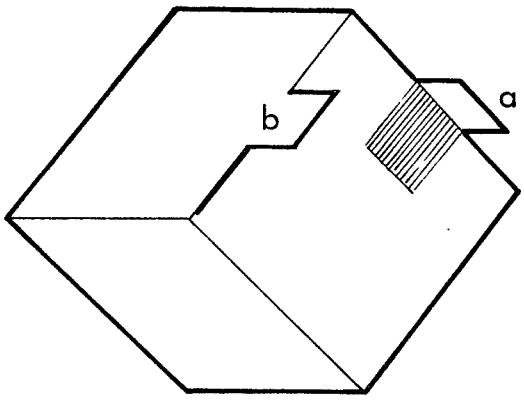

The different characteristics of the invention will be described in greater detail with the aid of embodiments represented schematically on the drawings, in which:

FIG. 1 represents a wall forming a bas-relief with light from the sun in different positions, FIG. 2 represents an embodiment of the elements entering into the composition of a bas-relief, FIG. 3 represents another embodiment of the elements entering into the composition of the bas-relief, FIG. 4 represents another embodiment of the elements entering into the composition of the bas-relief, FIG. 5 represents another variant of the embodiment of the invention.

The bas-relief with a motif which varies in accordance with the light and enables a motif or defined image to appear when it is illuminated by a defined incident light is described hereafter, using the sun as a particular source of light: the frequency of appearance of the image is then a function of the position of the sun and it is for that reason that this bas-relief is more particularly called, in this case, a solar bas-relief. However, the invention could in no case be limited to the utilization of this particular source of light.

In its apparent movement around the earth, the sun describes a large circle of the celestial sphere called the "ecliptic". The angle $\phi$ of the vertical of a location with a plane of the eclipticl varies in accordance with the seasons and in particular in the tropics, this angle becomes zero once a year, when the sun passes through its zenith (summer solstice).

For a defined day Jo of the year, the plane of the ecliptic makes an angle $\phi$ with the vertical of a given location: in consequence, if a surface is placed parallel to the plane of the ecliptic on that day, all the concavities provided on the surface will be in the dark. On the following days, as the angle of the plane of the ecliptic and of the vertical of a given location diminishes up to the summer solstice, the southern face of the surface is in complete shadow. After the summer solstice, the plane of the ecliptic progressively approaches the plane of the surface until, again, the southern face of the latter is illuminated.

FIG. 1 represents a wall forming the bas-relief and placed from east to west in a substropical region: the plane of the wall and the plane of the notch make an angle of 23', an angle which corresponds moreover to the average displacement of the plane of the ecliptic in 1 day.

FIG. 1*a* represents the position of the sun on the day preceding the appearance of the image, the whole of the plane of the wall than being in shadow.

FIG. 1*b* is the position of the sun the day of the appearance: on that day, the plane of the ecliptic is in the angle formed by the plane of the wall and the plane forming the notch. Thus, the notch AB is not illuminated, whereas the wall is illuminated over all its surface, thus allowing the pattern of the notch to appear in the shadow area. As the plane of the notch makes an angle of 23′ with the plane of the wall, on the following day, (FIG. 1*c*), the plane of the notch is then illuminated for the same reason as the plane of the wall and the image has disappeared. Of course, the angle $\alpha$ of the plane of the notch with the plane of the wall depends on the duration of the appearance of the image and for a minimum duration of a day corresponds to a minimum angle of 23′, an angle equal to the angle described by the plane of the ecliptic in 1 day.

The juxtaposition of the shadow spots suitably arranged with respect to one another enables an original image to be reproduced at a given instant: thus, by dividing the original picture to be reproduced into a grid, by measuring the intensity of the grey in each of the divisions of the grid, it is possible to make a number representing its degree of grey in each case; if now the wall represented in FIG. 1 is made with bricks each with a notch whose area is directly proportional to the number representing the intensity of the measured degree of grey in the corresponding division, on the day of its appearance, the composition of the shadow spots in the notches reproduces the original pictures, obtained by viewing at a distance from the wall; the wall thus made constitutes what the inventor calls a "solar bas-relief", the bricks constituting the elements of this bas-relief.

FIG. 2 represents the elements of the bas-relief in the form of bricks entering into the construction of the solar bas-relief.

The bricks, substantially of parallelepidedic form, have a plane front face: this face comprises a notch whose area is variable in accordance with the area of the shadow that is desired.

The plane of the notch makes an angle $\alpha$ with the plane of the front face of the brick, an angle whose value determines the duration of the appearance of the image, as has been previously explained.

The different bricks represented in FIG. 2 each correspond to an intensity of grey varying from black to white, the black corresponding to the case where the notch represents the entire surface of the brick, the white corresponding to the case where the notch is inexistent on the plane surface of the brick. The ratio notch area to front face area of the brick determines the degree of intensity of the grey and is shown from one to six in the example given.

When the solar bas-relief has been made by suitable assembly of bricks, it is then necessary to orient the front plane of their faces to make the image appear at the desired instant: thus, this plane must correspond to at least one plane of the ecliptic during the year so that the image can appear. Thus, if the bas-relief is placed on a tropic, and it is desired that the image appear on the summer solstice day, the front face of the bricks must be vertical. If the same bas-relief is placed in a subtropical region, it can occupy a position slightly inclined toward the north, or toward the south, and if it is placed in a temperate region, it must be inclined toward the south. In these cases, the appearance of the image depends on the height of the sun, that is to say the angle which the ecliptic makes with the vertical of a given location and this will occur only on one or two defined moments of the year.

Images can also be made to appear every day, at certain hours: in that case, the orientation of the bas-relief is north-south, and does not depend on the azimuth of the sun. This bas-relief, in certain cases, can be used as a sun dial.

FIG. 3 represents a variant of the construction of the bricks shown in FIG. 2: thus, the inclination of the plane of the bas-relief toward the south in a temperate region, has a disadvantage insofar as the stability of the latter is concerned. However, since the illumination of the front face of the bas-relief depends solely on the inclination of the faces of the bricks with respect to the plane of the ecliptic, it is possible to make a vertical bas-relief, the front face of the bricks then being inclined at an angle $\phi$ with respect to the vertical, the angle $\alpha$ of the notch and the front face being, as before, a function of the desired duration of the appearance of the image. This arrangement also has the advantage of allowing the appearance of an image on different dates by making a bas-relief consisting of bricks having different angles, corresponding to the latitude of the ecliptic at various periods of the year.

In addition, by progressively varying the value of the angle $\phi$ for bricks constituting a bas-relief, it is possible to make a linked blend of images operating for example from morning to evening.

According to a variant of the embodiment (see FIG. 4), the shadow area on each of the bricks is no longer made by means of a notch, provided inside the forward face of the latter, but with a horizontal screen whose projection and width are function of the intensity of the degree of grey desired. This projection moreover can be made in both cases of bricks shown in FIGS. 2 and 3.

According to another variant of the embodiment (see FIG. 5), the bricks are no longer stacked onto one another horizontally, but inclined at 45° and comprise on each of its two lateral faces projections in the form of plates: the plate on the east side gives a shadow on the brick during the morning, to give a first image, whilst the sheets, on the edge on the west side, give a shadow in the afternoon revealing a second image.

Of course, the invention is not limited to the examples of its embodiment hereinabove described and illustrated, and on the basis of which other modes and other forms of embodiment can be envisaged, without departing from the scope of the invention.

We claim:

1. A method of producing a bas-relief with a motif which varies in accordance with the light projected on the bas-relief comprising the steps of:

a. dividing a picture to be reproduced into a plurality of divisions;

b. measuring the intensity of the grey in each division;

c. assigning a numerical value to each division proportional to the intensity of grey measured in each respective division, said values varying from a value representative of white to a value representative of black;

d. providing a three dimensional element for representing each division;

e. providing means on each of said elements for producing a shadow on said element, said shadow having an area corresponding to the assigned value of grey intensity for the division which said element represents; and f. arranging said elements in the manner in which the divisions are arranged in the picture.

2. A method in accordance with claim 1 wherein step (f) includes arranging the elements in such a manner that the faces of said elements upon which the shadows are produced are generally parallel to a single plane.

3. A method in accordance with claim 1 wherein the means recited in step (e) includes providing a notch in a face of each of a plurality of said elements, the surface area of said notch being proportional to said assigned numerical value and ranging in size from covering substantially the entire face of an element that represents black to no notch in the face of an element that represents white.

4. A method in accordance with claim 3 wherein each notch is angled inwardly with respect to the face of the element in which the notch is provided and away from an illuminating light source.

5. A method in accordance with claim 4 wherein the face of each element in which said notch is provided is disposed in a generally vertical direction.

6. A method in accordance with claim 4 wherein the face of each element in which said notch is provided is disposed at an angle relative to the vertical.

7. A method in accordance with claim 1 wherein the means recited in step (e) includes attaching a projection to each of a plurality of said elements, said projection extending outwardly from a face of the element, the length and width of said projection being proportional to said assigned numerical value and ranging in size from a projection which produces a shadow that covers substantially the entire face of an element that represents black to no projection from an element that represents white.

8. A method in accordance with claim 7 wherein the means recited in step (e) includes attaching first and second projections to each of a plurality of elements, said first projection extending outwardly from a face of an element adjacent a first edge and said second projection extending outwardly from said face adjacent a second edge of the element, the length and width of said first projection being proportional to the numerical value assigned to the divisions corresponding to said element for forming a first picture and the length and width of said second projection being proportional to the numerical values assigned to the division corresponding to said element for forming a second picture.

9. A method in accordance with claim 7 wherein said projection extends outwardly from a face of the element adjacent an edge of the element, and said projection and edge are disposed in a generally horizontal direction.

10. A method in accordance with claim 8 wherein said first projection and first edge are disposed at an angle relative to the horizontal, and said second projection and second edge are disposed at another angle relative to the horizontal.

* * * * *